United States Patent [19]

Welch

[11] 4,121,319

[45] Oct. 24, 1978

[54] RELEASABLE RETAINING MEANS

[75] Inventor: Anthony Harold Ernest Welch, Corsham, England

[73] Assignee: Dorgard Limited, Corsham, England

[21] Appl. No.: 793,433

[22] Filed: May 3, 1977

[30] Foreign Application Priority Data

May 11, 1976 [GB] United Kingdom ..... 19352/76

[51] Int. Cl.[2] ..... E05F 3/00

[52] U.S. Cl. ..... 16/66; 16/48.5; 16/84

[58] Field of Search ..... 16/48.5, 49, 66, 65, 16/71, 82, 84, 85, 86 B; 109/63.5; 292/341.12, 252, 144

[56] References Cited

U.S. PATENT DOCUMENTS

| | | | |
|---|---|---|---|
| 2,813,294 | 11/1957 | Civitelli | 16/82 X |
| 3,219,374 | 11/1965 | Snell | 292/252 |
| 3,394,427 | 7/1968 | Vietz | 16/48.5 |
| 3,553,984 | 1/1971 | Grumback | 292/252 X |
| 3,764,172 | 10/1973 | Standoke | 292/252 X |

FOREIGN PATENT DOCUMENTS

| | | | |
|---|---|---|---|
| 1,043,198 | 9/1966 | United Kingdom | 16/84 |

*Primary Examiner*—Ronald Feldbaum
*Attorney, Agent, or Firm*—Young & Thompson

[57] ABSTRACT

Means are provided for retaining fire doors in the open position against the action of the spring or other automatic door closers, with remote control release which can be actuated if a fire is detected. In use, one part thereof is mounted on the wall and has gripper means for engagement with another part which is mounted on the door. The wall-mounted part also includes release means spring-biased into a first position in which operation of the gripper means is inhibited and pneumatically operated means for holding the release means in a second position in which operation of the gripper means is not inhibited.

9 Claims, 3 Drawing Figures

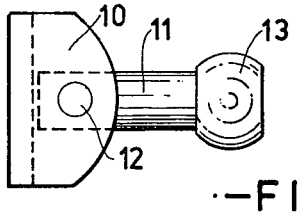
-FIG.1-
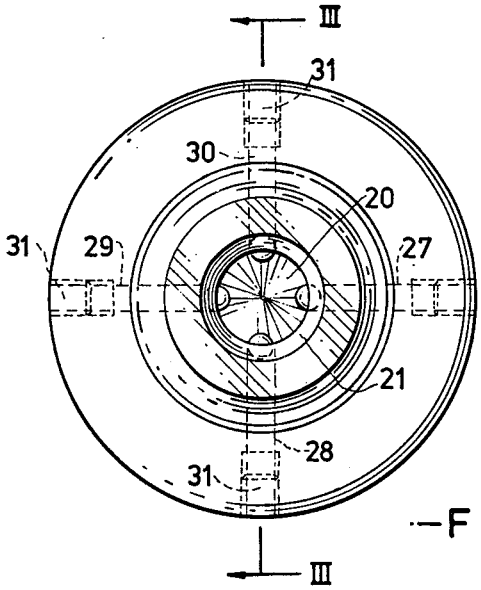
-FIG.2-
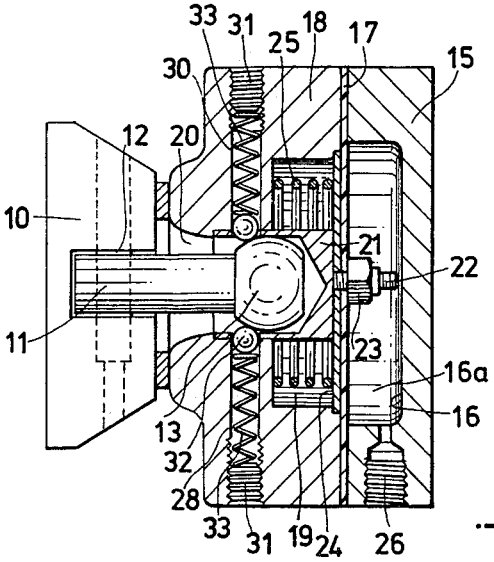
-FIG.3-

RELEASABLE RETAINING MEANS

FIELD OF THE INVENTION

This invention relates to releasable retaining means for controlling displacement of an object from a predetermined position relative to another object and has particular, though not exclusive, application to a door control for holding a door in the open position against the action of a spring or other automatic door closer.

BACKGROUND OF THE INVENTION

Hospitals, schools, hotels, offices, factories and other like buildings are commonly provided with so-called fire doors which, although they may have only a limited resistance to combustion, also serve the purpose of restricting the spread of smoke and/or the supply of combustion air in the event of a fire. Because of this latter purpose, it is desirable that all fire doors in a building should be closed immediately a fire breaks out even if such doors are remote from the seat of the fire. For this reason, it is preferred that fire doors be kept shut at all times. However, in practice, they are frequently wedged open to permit free passage.

This invention provides means which are applicable, inter alia, for retaining fire doors in the open position against the action of the spring or other automatic door closers, with remote control release and which can be actuated if a fire is detected.

SUMMARY OF THE INVENTION

According to the invention, there is provided retaining means for controlling displacement of an object from a predetermined position relative to another object, comprising a first part for mounting on one of the objects and a second part for mounting on the other object and having gripper means for engagement with the first part, release means spring-biased into a first position in which operation of the gripper means is inhibited and pneumatically operated means for holding the release means in a second position in which operation of the gripper means is not inhibited.

BRIEF DESCRIPTION OF THE DRAWINGS

FIG. 1 is a plan view of a first part of a door holder in accordance with the invention, FIG. 2 is a front elevational view of a second part of a door holder in accordance with the invention, and FIG. 3 is a cross-sectional view taken on the line III—III of FIG. 2, showing the first part of the door holder in engagement with the second part thereof.

DESCRIPTION OF THE PREFERRED EMBODIMENT

Referring first to FIG. 1, the part of the door holder intended to be mounted on to the door comprises a bracket 10 for mounting on the face of the door which confronts an adjacent wall when the door is open. A horizontally projecting arm 11 is pivotally mounted on the bracket 10 for limited angular movement about a pivot pin 12 and a flattened spherical element 13 is mounted on the outer end of the arm. The arm 11 is a loose fit on the pivot pin 12 and the flattened spherical element 13 is a loose fit on the end of the arm so as to form a sort of floating knob, the arrangement being such as to provide a degree of tolerance for the positioning of the bracket 10 on the door relatively to the position of the other part of the door holder with which it is to engage.

FIGS. 2 and 3 show the other part of the door holder which comprises a base member 15 for mounting on a wall against which the door opens. The base member 15 has a recess 16 opening on the side remote from the wall and which is closed by a diaphragm 17 to form a chamber **16*a*, the diaphragm being clamped against the base member 15 by an outer housing member 18. The housing member 18 is also formed with a recess 19 which is closed by the diaphragm on one side and which communicates with a through bore 20 on the other. A hollow cylindrical slider 21 is mounted in the through bore 20 and has a closed end in contact with the diaphragm 17. A threaded stud 22 on the slider 21 projects through the diaphragm 17 enabling the slider to be clamped to the diaphragm 17 by a nut 23. A plate 24 clamped between the diaphragm 17 and the slider 21 engages in a stepped portion of the periphery of the recess 19 to prevent the diaphragm 17 from bowing into the recess 19 while allowing it to bow into the chamber 16*a*. However, the extent of travel of this latter bowing action is limited by abutment of the end of the stud 22 with the wall of the recess 16. A spring 25 in the recess 19 engages with the plate 24 to urge the diaphragm and slider away from the position shown in FIG. 3 so that the end of the stud 22 engages with the wall of the recess 16. A pneumatic inlet 26 communicates with the chamber 16*a* so that, by application of air pressure thereto, the diaphragm 17 may be displaced into the position shown in FIG. 3, thereby compressing the spring 25**.

Four symmetrically disposed radial bores 27, 28, 29 and 30 extend inwardly to the central axial bore 20 in the housing member 18. Each of these radial bores 27, 28, 29 and 30 is aligned with a respective hole of smaller diameter in the slider 21 when the latter, together with the diaphragm 17, is in the position shown in FIG. 3. The outer end of each of the radial bores 27, 28, 29 and 30 is closed by a plug 31 and a steel ball 32, of diameter larger than that of the corresponding hole in the slider 21, is disposed at the inner end thereof. A spring 33 is disposed between the plug 31 and steel ball 32 to urge the latter into contact with the slider 21 so that, when the latter is in the position shown in FIG. 3, the ball 32 protrudes through the corresponding hole therein. Accordingly, when the door is opened and the stem 11 of the part mounted thereon enters the axial bore 20 of the housing member 18, the knob 13 depresses the balls 32 in their radial bores against the loading of their springs 33, the balls being spring returned to engage behind the knob 13 after it has passed to the position shown in FIG. 3 to retain the door in the open position. However, if the door is pulled with a force sufficient to compress the springs 33, the balls 32 are pressed outwardly in their radial bores clear of the path of the knob 13 and the holder releases. The knob 13 and balls 32 thus form a spring catch.

In normal use, compressed air is supplied to the chamber **16*a* by way of the inlet 26 in order to maintain the diaphragm in the position shown in FIG. 3 so that the holder operates as described above. However, if the air pressure in the chamber 16*a* is reduced so that the diaphragm 17 is moved to the right, as viewed in FIG. 3, by the spring 25 the holes in the slider 21 move out of alignment with the radial bores 27, 28, 29 and 30 and press the balls 32 radially outwardly and clear of the path of the knob 13**, thereby releasing the door.

In a building having a number of fire doors equipped with door holders in accordance with the invention, the pneumatic inlets 26 of all the door holders may be connected to a common source of compressed air. A pressure of up to 80 lbs./sq. in. is appropriate for the purpose. Means for releasing the pressure in the connecting pipework may be associated with the fire alarm system of the building so that when smoke or a fire is detected automatically, or when the alarm is operated manually, the fire doors are closed. Since the presence of air pressure is required to keep the doors open, any fault in the system will cause the doors to close, thereby providing fail-safe operation. In addition, when the building is not occupied, it will be sufficient to turn off the air pressure, to cause all the fire doors to close.

As used hereinbefore and in the appended claims, the term "pneumatically operated means" is intended to include not only means operated by air but also means operated by fluids other than air.

I claim:

1. Retaining means for controlling displacement of an object from a predetermined position relative to another object, comprising a first part for mounting on one of the objects and a second part for mounting on the other object and having gripper means for engagement with the first part, release means spring-biased into a first position in which operation of the gripper means is inhibited and pneumatically operated means for holding the release means in a second position in which operation of the gripper means is not inhibited.

2. Retaining means according to claim 1, wherein the gripper means is operative, when the release means is in its second position, to permit the first part to disengage from the gripper means on application of a displacing force exceeding a threshold value.

3. Retaining means according to claim 1, wherein the first part comprises a member which cooperates with a member of the gripper means to form a spring catch.

4. Retaining means according to claim 1, wherein the first part has a detent surface and the gripper means comprises a plunger displaceable in a direction perpendicular to the direction of relative displacement of the first and second parts and spring loaded into engagement with the detent surface, the release means being operative, when in its first position, to reduce the force exerted on the detent surface by the plunger.

5. Retaining means according to claim 4, wherein the release means is operative to displace the plunger out of engagement with the detent surface.

6. Retaining means according to claim 4, wherein the release means comprises a slider movable between said first and second positions in a direction parallel to the direction of relative displacement of the first and second parts, the slider having a hole through which said plunger projects when the slider is in its second position.

7. Retaining means according to claim 4, wherein the plunger is a ball or equivalent rolling member.

8. Retaining means according to claim 4, wherein the detent surface is rounded and symmetrical about an axis parallel to the direction of relative displacement of the two parts and the gripper means comprises a plurality of plungers spaced around said axis.

9. Retaining means according to claim 1, wherein the pneumatically operated means comprises a chamber, one wall of which is formed by a diaphragm having the release means coupled to a central region thereof whereby establishment of a pressure differential across the diaphragm causes the release means to be moved from said first position to said second position.

* * * * *